US006905352B2

(12) United States Patent
Chao

(10) Patent No.: US 6,905,352 B2
(45) Date of Patent: Jun. 14, 2005

(54) USB MOBILE DISK-PEN

(75) Inventor: Henry Chao, Taipei (TW)

(73) Assignee: Prosonic Technology Corp., Taipei (TW)

( * ) Notice: Subject to any disclaimer, the term of this patent is extended or adjusted under 35 U.S.C. 154(b) by 73 days.

(21) Appl. No.: 10/614,094

(22) Filed: Jul. 8, 2003

(65) Prior Publication Data

US 2005/0009388 A1 Jan. 13, 2005

(51) Int. Cl.[7] ..... H01R 13/44
(52) U.S. Cl. ..... 439/135; 401/195
(58) Field of Search ..... 439/135, 149; 401/195, 194, 52; 362/118

(56) References Cited

U.S. PATENT DOCUMENTS 6,238,119 B1 * 5/2001 Liu ..... 401/195
6,666,564 B1 * 12/2003 Su ..... 362/118
6,773,192 B1 * 8/2004 Chao ..... 401/195
2004/0080989 A1 * 4/2004 Yu ..... 365/200

* cited by examiner

*Primary Examiner*—Phuong Dinh
(74) *Attorney, Agent, or Firm*—Bacon & Thomas

(57) ABSTRACT

A USB portable disk-pen includes a USB plug that is inserted to a computer at an upper pen shaft, and is joined as one body with a sheath. A printed circuit board is connected with one end of the sheath, penetrated into the sheath, and positioned along with the sheath in the upper pen shaft. The upper pen shaft is relative lighter in weight for not containing a refill, and is therefore steadier and less likely to wobble when being inserted to a computer, thereby preventing poor contact quality of the USB plug.

1 Claim, 4 Drawing Sheets

USB MOBILE DISK-PEN

BACKGROUND OF THE INVENTION (a) Field of the Invention

The invention relates to a USB plug for mobile flash drive and disposed, at an upper end of a pen shaft, thereby ensuring stability thereof when being inserted to a computer as well as enabling up-and-down adjustment of a refill within the pen shaft.

(b) Description of the Prior Art

Referring to FIG. 1 showing a common USB flash drive 100, wherein an USB plug 101 is inserted into a USB receptacle of a computer for accessing data. However, the flash drive 100 has no other purpose besides data storage, and is also rather awkward to carried along with. Industrialists have later developed a portable mobile disk-pen 200 as shown in FIG. 2, the pen comprises a USB plug 202 secured at a top end of a lower pen shaft 201. The USB plug 202 is stored in an upper pen sheath 203 when not in use, and an outer periphery of a refill 2011 at a lower end of the lower pen shaft 201 is fixed with a pen cap 204, such that the pen is both capable of writing and serving ap a mobile disk. Yet, this prior mobile disk-pen 200 has the following drawbacks when put to practice:

1. The USB plug 202 is installed at the lower pen shaft 201, which has a relatively longer body and is heavier because of the refill 2011 contained. As a result, the USB plug. 202 inevitably bears a relatively larger load when being inserted into a USB receptacle of a computer, and thus often leading to poor contact.
2. The USB plug 202 is joined with the lower pen shaft 201 via a connected single printed circuit board (PCB) 2021, and is therefore prone to wobble and again cause poor contact when being inserted into a USB receptacle of a computer.
3. The lower pen shaft 201 is secured with the USB plug 202 at an interior thereof, and thus no other refill can be replaced once the refill 2011 is consumed.
4. The outer periphery of the refill 2011 of the lower pen shaft 201 is necessarily accommodated within the pen cap 204, and the pen cap 204 is easily lost for that it is a separate part from the lower pen shaft 201.

SUMMARY OF THE INVENTION

The primary object of the invention is to dispose a USB plug of a flash drive within an upper pen shaft, such that not only the USB plug offers better stability when being inserted to a computer, but also a refill in a lower pen shaft is designed as an adjustable structure.

DETAILED DESCRIPTION OF THE PREFERRED EMBODIMENTS

To better understand the invention, detailed descriptions shall be given with the accompanying drawings hereunder.

Figure 1:
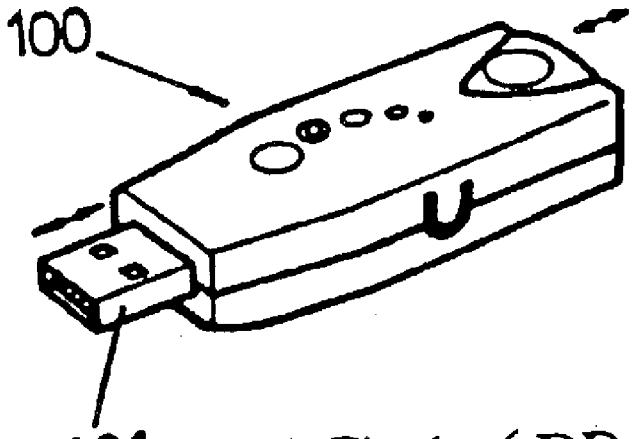
FIG.1 (PRIOR ART)
FIG. 1 shows a conventional elevational view of a prior art.
Figure 2:
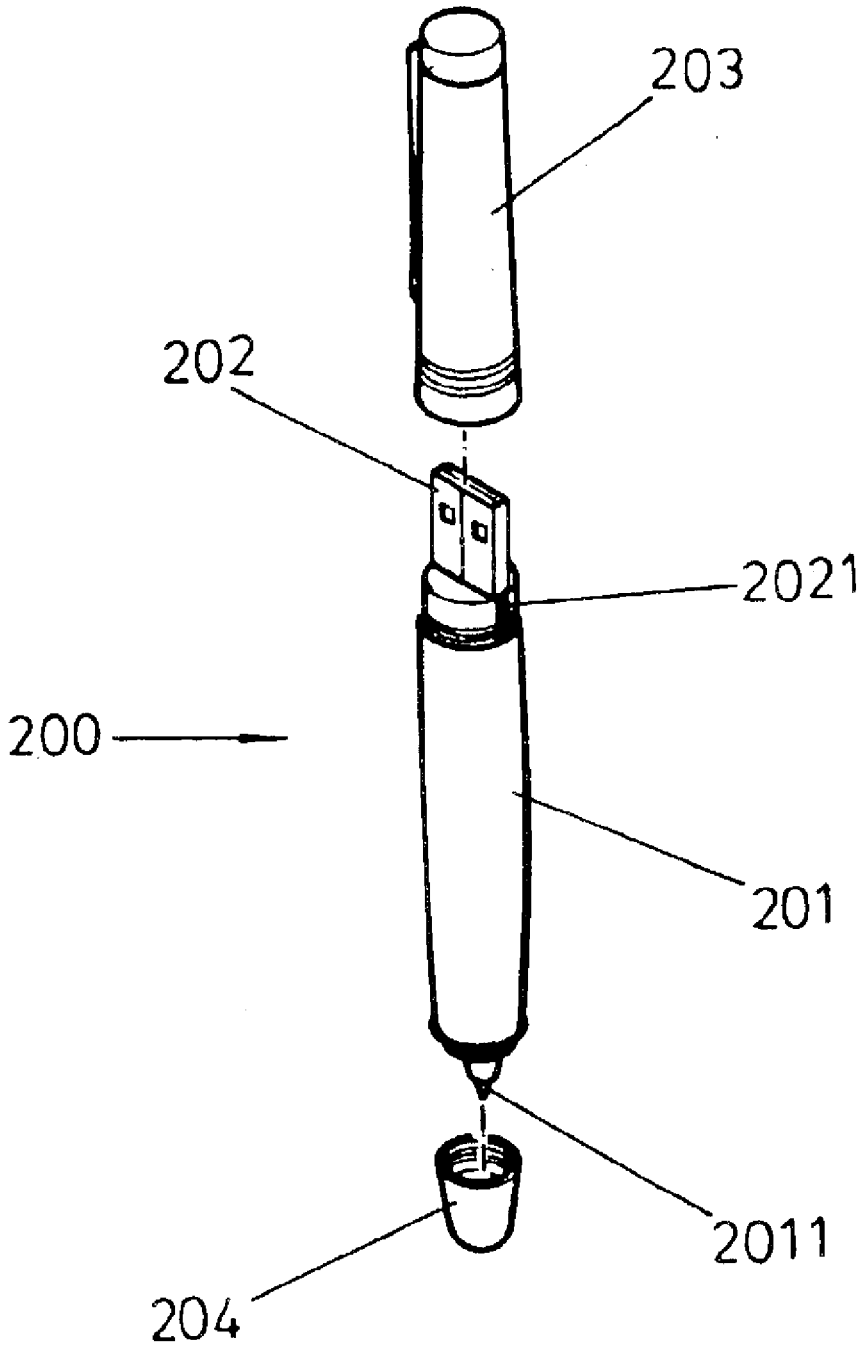
FIG.2 (PRIOR ART)
FIG. 2 shows a conventional exploded view of another prior art.
Figure 3:
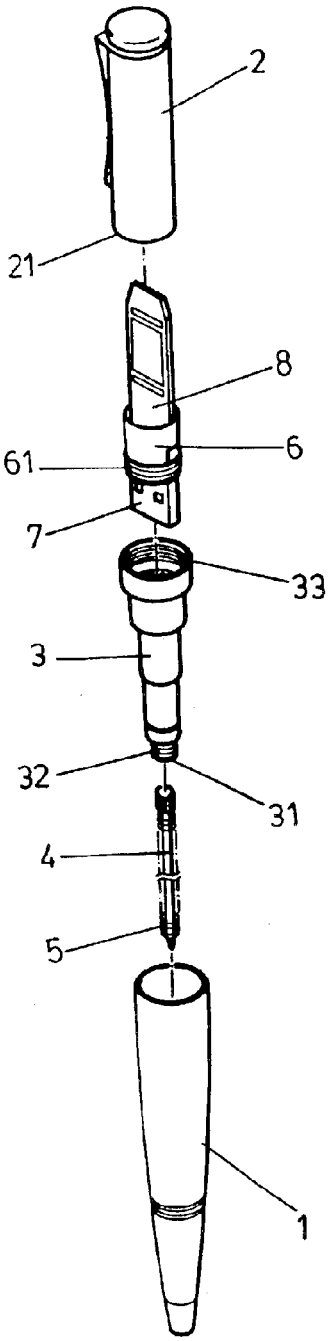
FIG. 3 shows an exploded view according to the invention.
Figure 4:
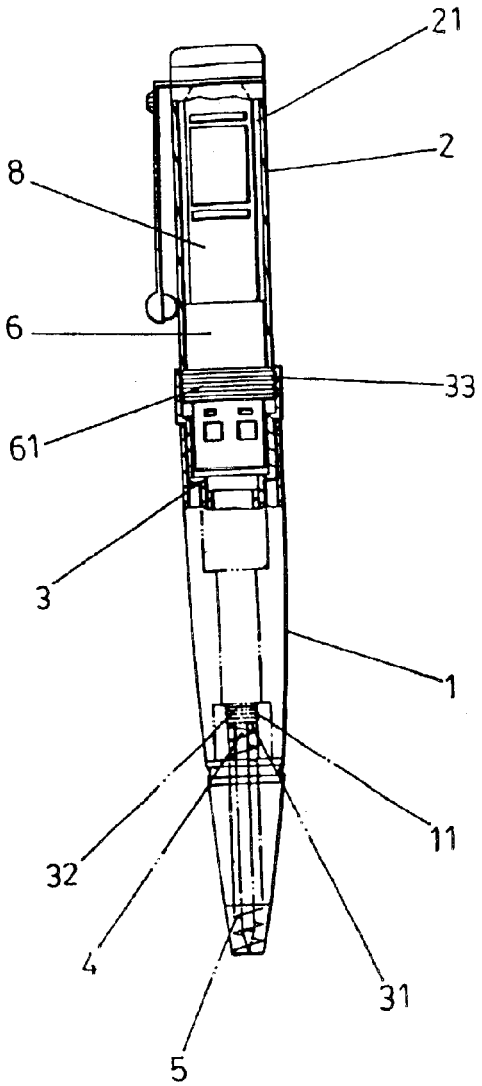
FIG. 4 shows a sectional view according to the invention.
Figure 5:
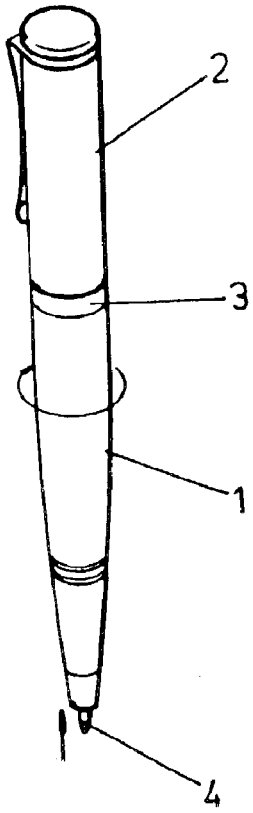
FIG. 5 shows a schematic view illustrating actions according to the invention.

Referring to FIGS. 3 and 4, the invention comprises a lower pen shaft 1, an upper pen shaft 2, a lower pen housing 3, a refill 4, a spring 5, a sheath 6, a USB plug 7 and a PCB 8. An upper portion of the refill 4 is simultaneously extended into a pen opening 31 at a lower end of the lower pen housing 3 when the refill 4 is penetrated through the spring 5. A lower outer periphery of the lower pen housing 3 is provided with a screw pillar 32 for coordinating with a screw opening 11 at an inner periphery of the lower pen shaft 1, thereby fastening the screw pillar 32 of the lower pen housing 3 into the screw opening 11 of the lower pen shaft 1 as shown in FIG. 4. When the screw pillar 32 of the lower pen housing 3 is turned to a lowermost position thereof, the lower pen housing 3 compresses the spring 5 and at the same time downward presses the refill 4 to outwardly stretch the lower pen shaft 1 as shown in FIG. 5. When the lower pen housing 3 is turned in an upward direction, the refilled 4 is withdrawn and restored into the lower pen shaft 1. In addition, an upper inner periphery of the lower pen shaft 3 is disposed with an internal screw thread 33.

The characteristics of the invention are that, the USB plug 7 is joined as one body with the sheath 6; the PCB 8 connected with one end of the USB plug 7 is penetrated into the sheath 6; the sheath 6 and the PCB 8 are together inserted and secured in an only shaft opening 21 of the upper pen shaft 2; and a lower outer periphery of the sheath 6 is disposed with an external screw thread 61 for fastening with the internal screw thread 33 at the lower pen housing 3, thereby combining the upper and lower pen shafts 2 and 1 into one body as shown in FIG. 4.

Figure 6:
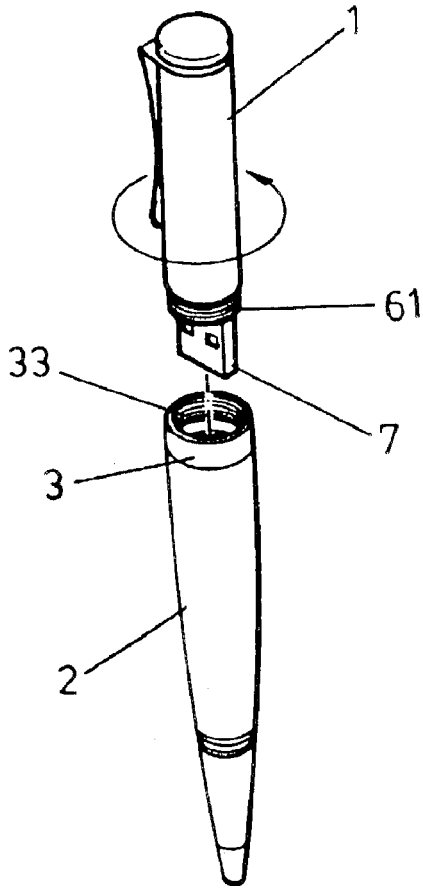
FIG. 6 shows a schematic view illustrating the upper and lower pen shafts according to the invention being separated.

Referring to FIG. 6, to insert the USB plug 7 into a USB receptacle of a computer, only the upper pen shaft 2 needs to be rotated, and the USB plug 7 positioned at a lower end of the upper pen shaft 2 may be separated from an opening of the lower pen housing 3.

Conclusive from the above, according to the invention, a USB plug is combined within an upper pen shaft, thereby overcoming the aforesaid drawbacks of prior inventions and bringing the following excellences:

1. The upper pen shaft is relatively short and also lighter in weigh for not containing a refill. The USB plug connected with the upper pen shaft is steadier and does riot incur poor contact when being inserted to a computer.
2. The USB plug is directly combined with the sheath but not with a PCB board having a smaller thickness, and therefore the USB plug is less likely to wobble, and also offers better contact quality when being inserted to a computer.
3. The lower pen shaft is not fixed with the USB plug, and hence the refill in the lower pen shaft may be designed as a structure capable of up-and-down adjustment, thereby eliminating parts such as a pen cap at an outer periphery of the refill.
4. The refill in the lower pen shaft is easily accessible on the market for replacement, thereby ensuring writing purposes at all time.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A USB mobile disk-pen comprising:

a lower pen shaft an upper pen shaft, a lower pen housing, a refill, a spring, a sheath, a USB plug and a printed circuit board (PCB);

the refill is simultaneously extended into a pen opening at a lower end of the lower pen housing when being penetrated through the spring;

one end of the lower pen housing is provided with a screw pillar for coordinating with a screw opening at an inner periphery of the lower pen shaft;

the refill is withdrawn or extended in the lower pen shaft through compression of the spring on the refill using the lower pen shaft;

the lower pen housing is provided with an internal screw thread, such that the screw pillar is detachably and threadedly secured to the lower pen shaft to permit the replacement of the refill; and the sheath is joined with the USB plug, and one end of the sheath is connected with the PCB that is penetrated into the sheath and the sheath connected with the PCB are positioned with the sheath in a shaft opening of the upper pen shaft, and another end of the sheath is disposed with an external screw thread for fastening with the internal screw thread at the lower pen housing, to permit the combining of the upper and lower pen shafts into one body.

* * * * *